US008602811B2

(12) United States Patent
Takahashi

(10) Patent No.: US 8,602,811 B2
(45) Date of Patent: Dec. 10, 2013

(54) CONNECTOR ASSEMBLY INCLUDING FIRST CONNECTOR AND SECOND CONNECTOR CONFIGURED TO BE MOUNTED ON A CIRCUIT BOARD AND EASILY MATED

(75) Inventor: Takuya Takahashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 281 days.

(21) Appl. No.: 13/074,331

(22) Filed: Mar. 29, 2011

(65) Prior Publication Data

US 2011/0244711 A1 Oct. 6, 2011

(30) Foreign Application Priority Data

Mar. 30, 2010 (JP) ..... 2010-079568
Jul. 12, 2010 (JP) ..... 2010-157589

(51) Int. Cl.
*H01R 13/64* (2006.01)

(52) U.S. Cl.
USPC ..... 439/376; 439/74

(58) Field of Classification Search
USPC ..... 439/74, 284, 342, 295, 287, 376
See application file for complete search history.

(56) References Cited

U.S. PATENT DOCUMENTS 1,967,021 A * 7/1934 Gary ..... 439/677
2,877,442 A * 3/1959 Gettig ..... 439/861
3,078,433 A * 2/1963 Sheesley ..... 439/278
4,349,239 A * 9/1982 Roberts et al. ..... 439/287
5,098,311 A * 3/1992 Roath et al. ..... 439/295
5,161,985 A * 11/1992 Ramsey ..... 439/74
5,299,939 A 4/1994 Walker et al.
5,498,167 A * 3/1996 Seto et al. ..... 439/74
5,885,092 A * 3/1999 Ito et al. ..... 439/74
6,969,274 B2 * 11/2005 Kudo et al. ..... 439/495

(Continued)

FOREIGN PATENT DOCUMENTS

CN 201171094 Y 12/2008
CN 201171095 Y 12/2008

(Continued)

OTHER PUBLICATIONS

Finnish Office Action dated Nov. 25, 2011 (and English translation thereof) in counterpart Finnish Application No. 20115296.

(Continued)

*Primary Examiner* — Neil Abrams
(74) *Attorney, Agent, or Firm* — Holtz, Holtz, Goodman & Chick, PC

(57) ABSTRACT

A first connector has a first holding member holding first male and female terminals. Each first male terminal has a horizontally extending first male contact. Each first female terminal has a first female contact. A second connector has a second holding member holding second male and female terminals. Each second male terminal has a horizontally extending second male contact receivable in the first female contact. Each second female terminal has a second female contact which receives the first male contact. The first and second connectors are positioned at a predetermined position in a vertical direction whereas the first male contact is apart from the second female contact while the second male contact is apart from the first female contact. A guiding mechanism guides the first connector to a position where the first and second male contacts are respectively connected to the second and first female contacts.

11 Claims, 14 Drawing Sheets

(56) References Cited

U.S. PATENT DOCUMENTS

| | | | | |
|---|---|---|---|---|
| 7,320,605 | B2 * | 1/2008 | Chang et al. | 439/74 |
| 7,597,584 | B2 * | 10/2009 | Yamaji | 439/495 |
| 7,927,122 | B2 * | 4/2011 | Yamaji et al. | 439/342 |
| 8,052,464 | B2 * | 11/2011 | Maruishi et al. | 439/496 |
| 8,083,527 | B2 * | 12/2011 | Takeuchi et al. | 439/65 |
| 8,388,370 | B2 * | 3/2013 | Yamaji et al. | 439/497 |
| 2004/0052059 | A1 | 3/2004 | Chang | |
| 2008/0026609 | A1 | 1/2008 | Kuwana et al. | |
| 2011/0244711 | A1 * | 10/2011 | Takahashi | 439/378 |
| 2013/0072037 | A1 * | 3/2013 | Takahashi et al. | 439/62 |

FOREIGN PATENT DOCUMENTS

| | | | |
|---|---|---|---|
| DE | 10 2007 031621 | A1 | 2/2009 |
| EP | 1 885 028 | A1 | 2/2008 |
| JP | 2000-260509 | A | 9/2000 |
| JP | 2005-251723 | A | 9/2005 |
| JP | 2007-109522 | A | 4/2007 |
| WO | WO 98/15990 | A1 | 4/1998 |

OTHER PUBLICATIONS

Chinese Office Action dated Mar. 26, 2013 (and English translation thereof) in counterpart Chinese Application No. 201110081729.2.

* cited by examiner

CONNECTOR ASSEMBLY INCLUDING FIRST CONNECTOR AND SECOND CONNECTOR CONFIGURED TO BE MOUNTED ON A CIRCUIT BOARD AND EASILY MATED

CROSS REFERENCE TO RELATED APPLICATIONS

Applicant claims priority under 35 U.S.C. §119 of Japanese Patent Application No. JP 2010-079568 filed Mar. 30, 2010 and JP 2010-157589 filed Jul. 12, 2010.

BACKGROUND OF THE INVENTION

The present invention relates to a connector assembly which comprises two connectors to be connected with each other.

JP-A 2007-109522 or JP-A 2000-260509 discloses a connector assembly for interconnecting a pair of circuit boards, the contents of JP-A 2007-109522 and JP-A 2000-260509 being incorporated herein by reference in their entirety.

However, the structures of the disclosed connector assemblies are not suitable for a low-profile design.

SUMMARY OF THE INVENTION

It is therefore an object of the present invention to provide a connector assembly which has a new structure suitable for a low-profile design.

One aspect of the present invention provides a connector assembly which comprises a first connector, a second connector, a positioning mechanism and a guiding mechanism. The first connector comprises a first holding member, a plurality of first male terminals and a plurality of first female terminals. The first holding member holds the first male terminals and the first female terminals. Each of the first male terminals comprises a first male contact which extends and is oriented in a first horizontal direction. Each of the first female terminals comprises a first female contact which opens toward the first horizontal direction. The second connector comprises a second holding member, a plurality of second male terminals and a plurality of second female terminals. The second holding member holds the second male terminals and the second female terminals. Each of the second male terminals has a second male contact which extends and is oriented in a second horizontal direction. The first female contact is receivable the second male contact. Each of the second female terminals comprises a second female contact which opens toward the second horizontal direction to be receivable the first male contact. The positioning mechanism is configured to position the first connector relative to the second connector at a relative predetermined position in a vertical direction perpendicular to the first horizontal direction and the second horizontal direction when the first connector and the second connector are arranged so that the first horizontal direction and the second horizontal direction are opposed to each other. The relative predetermined position is a position where the first male contact is directed to but apart from the second female contact in the first horizontal direction while the second male contact is directed to but is apart from the first female contact in the second horizontal direction. The guiding mechanism is configured to guide relative movement of the first connector from the relative predetermined position to a connection position along the first horizontal direction. The connection position is a position where the first male contact is connected to the second female contact while the second male contact is connected to the first female contact.

An appreciation of the objectives of the present invention and a more complete understanding of its structure may be had by studying the following description of the preferred embodiment and by referring to the accompanying drawings.

Figure 1:
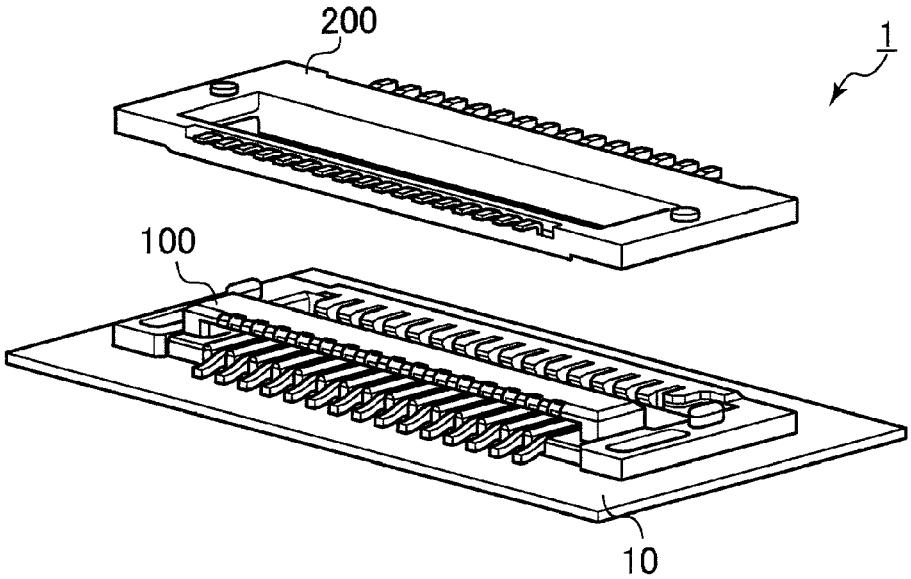
FIG. 1 is an oblique view showing a connector assembly according to a first embodiment of the present invention. A first connector is installed on a circuit board and is not connected to a second connector.

While the invention is susceptible to various alternative embodiments and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all alternative embodiments, equivalents and alternatives falling within the spirit and scope of the present invention as defined by the appended claims.

DESCRIPTION OF PREFERRED EMBODIMENTS

First Embodiment

With reference to FIGS. 1 to 8, a connector assembly 1 of the first embodiment of the present invention comprises a first connector 100 and a second connector 200. The first connector 100 and the second connector 200 are installed on and fixed to a first circuit board 10 and a second circuit board 20, respectively. As understood from FIGS. 1 to 3, 7 and 8, a structure of the first connector 100 is same as another structure of the second connector 200.

Figure 4:
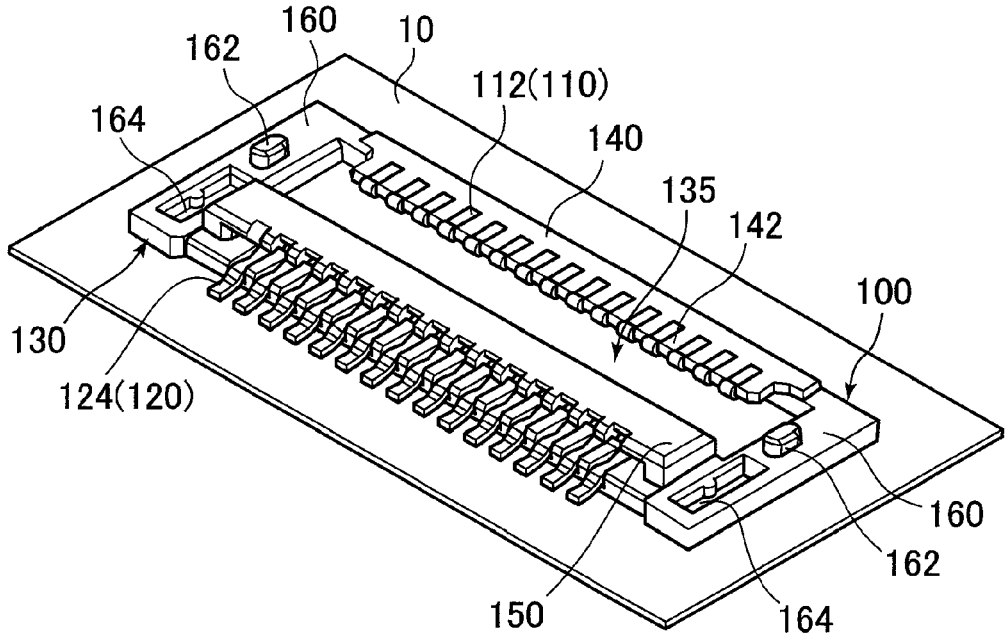
FIG. 4 is an oblique view showing the first connector of FIG. 1.
Figure 5:
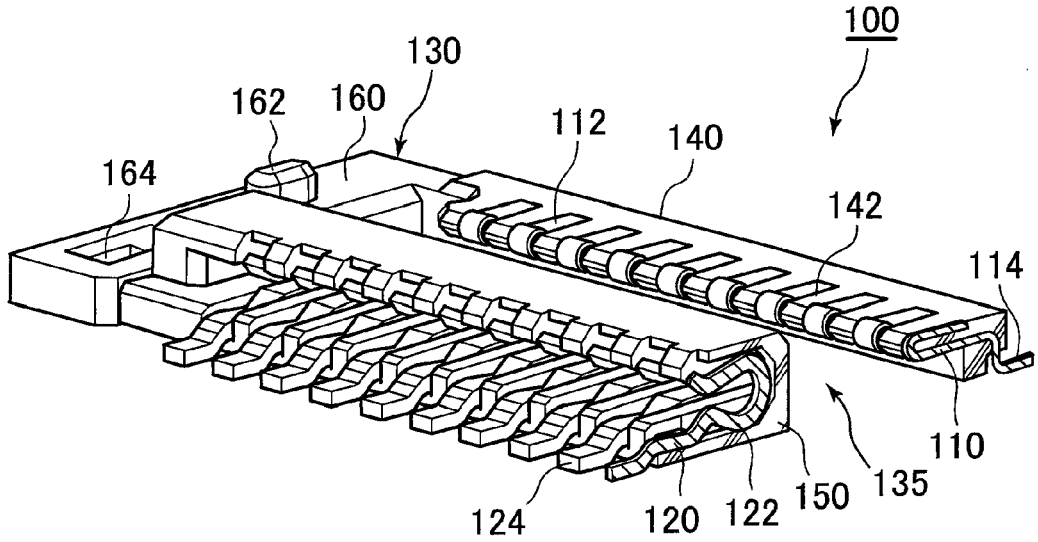
FIG. 5 is an oblique view showing a cross-section of the first connector of FIG. 4.
Figure 6:
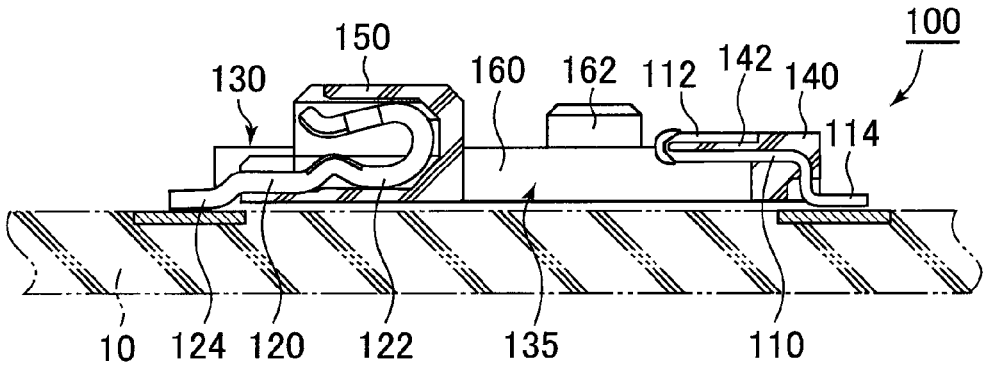
FIG. 6 is a cross-sectional view showing the first connector of FIG. 5.

With reference to FIGS. 4 to 6, the first connector 100 comprises a plurality of first male terminals 110, a plurality of first female terminals 120 and a first holding member 130. The first holding member 130 holds the first male terminals 110 and the first female terminals 120. The first male terminals 110 and the first female terminals 120 are made of metal.

Figure 3:
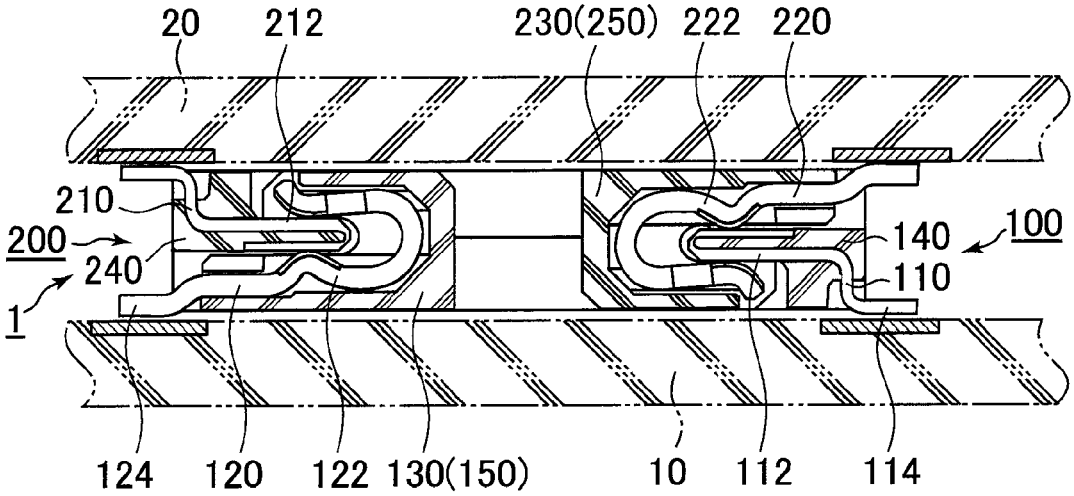
FIG. 3 is a cross-sectional view showing the connector assembly of FIG. 2. The first connector and the second connector are installed on the circuit boards. The first connector is connected to the second connector.

With reference to FIGS. 5 and 6, each of the first male terminals 110 comprises a first male contact 112 and a first male SMT terminal 114. The first male contact 112 extends and is oriented in a first horizontal direction. In this embodiment, the first horizontal direction is an unidirectional direction from a base of the first male contact 112 toward a tip of the first male contact 112, as shown in FIGS. 3 and 6. The first male SMT terminal 114 is configured to be fixed to the first circuit board 10. As shown in FIG. 6, the first male contact 112 has a U-like cross-section in a plane defined by the first horizontal direction and a vertical direction. The bottom part of the U-like cross-section of the first male contact 112 is oriented in the first horizontal direction.

With reference to FIGS. 5 and 6, each of the first female terminals 120 comprises a first female contact 122 and a first female SMT terminal 124. The first female contact 122 opens toward the first horizontal direction. In other words, a direction where the first female contact 122 opens is same as a direction where the first male contact 112 is oriented.

The first holding member 130 is made of insulator and comprises a first male holding portion 140, a first female holding portion 150 and a first connection portion 160. The first male holding portion 140 holds the first male terminals 110. The first female holding portion 150 holds the first female terminals 120. The first connection portion 160 connects between the first male holding portion 140 and the first female holding portion 150 in the first horizontal direction.

The first male holding portion 140 extends in a third horizontal direction perpendicular both to the first horizontal direction and the vertical direction (note that the third horizontal direction is not unidirectional but bidirectional). The first male holding portion 140 comprises a plate portion 142. The plate portion 142 has a plate-like shape extending in the third horizontal direction and has a top surface perpendicular to the vertical direction. As shown in FIG. 4, the first male terminals 110 are arranged in a single row in the third horizontal direction. In this embodiment, the first male holding portion 140 and the first male terminals 110 are formed integrally with each other by insert-molding process. However, other conventional processes may be applied.

The first female holding portion 150 extends in the third horizontal direction. As shown in FIG. 4, the first female terminals 120 are arranged in a single row in the third horizontal direction. The first female terminals 120 are press-fitted into the first female holding portion 150. In this embodiment, the first female terminals 120 are positioned forwards of the first male terminals 110 in the first horizontal direction.

With reference to FIG. 6, each of the first male SMT terminals 114 is oriented to the outside of the first connector 100 and extends in a direction opposite to the first horizontal direction. On the other hand, each of the first female SMT terminals 124 is oriented to the outside of the first connector 100 and extends in the first horizontal direction.

With reference to FIG. 4, the first connection portion 160 comprises two connection bridges. The first male holding portion 140 has two end portions in the third horizontal direction while the first female holding portion 150 has two end portions in the third horizontal direction. Each of the connection bridges of the first connection portion 160 connects between one of the end portions of the first male holding portion 140 and one of the end portions of the first female holding portion 150. The first male holding portion 140, the first female holding portion 150 and the connection bridges of the first connection portion 160 form a rectangular flame-like shape when seen along the vertical direction.

With reference to FIG. 4, each of the connection bridges of the first connection portion 160 comprises a projection portion 162 projecting in the vertical direction and a groove portion 164. The length of the groove portion 164 is more than twice as long as the length of the projection portion 162 in the first horizontal direction.

With reference to FIGS. 5 and 6, the first holding member 130 comprises a first accommodation portion 135. The first accommodation portion 135 is positioned between the first male holding portion 140 and the first female holding portion 150 in the first horizontal direction. In other words, the first accommodation portion 135 is an inner space surrounded by the first male holding portion 140, the first female holding portion 150 and the first connection portion 160. As understood from FIGS. 4 and 6, the size of the first accommodation portion 135 is slightly larger than the size of the first female holding portion 150 in the first horizontal direction and the third horizontal direction. As shown in FIG. 6, the first female holding portion 150 is the highest portion among portions of the first connector 100. The height of the first connection portion 160 is about half of the height of the first female holding portion 150.

The first accommodation portion 135 of the present embodiment has an opening shape so that, when seen the first circuit board 10 is viewed from above the first connector 100, the first circuit board 10 can be seen through the first accommodation portion 135. However, the first accommodation portion 135 may comprise a bottom portion so that the first accommodation portion 135 has an angular U-like cross-section in a plane perpendicular to the third direction.

Figure 2:
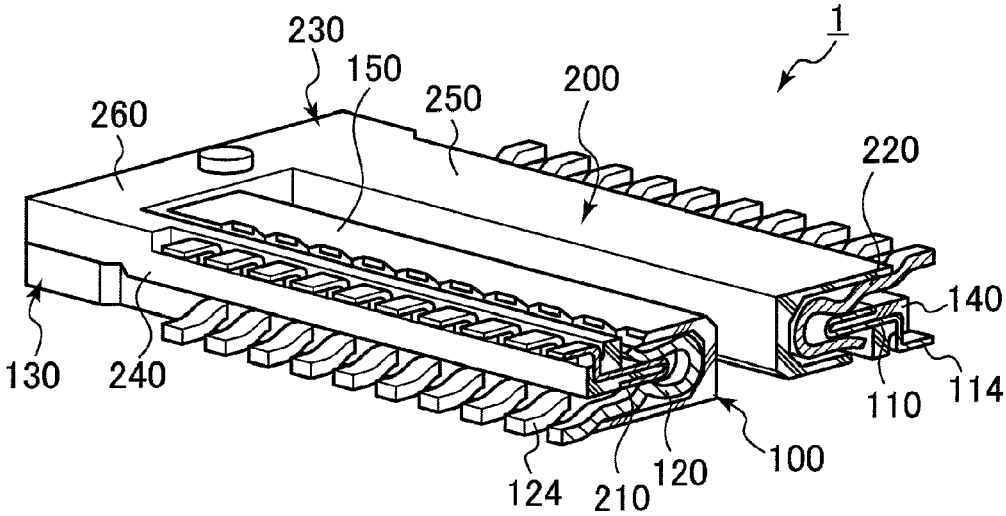
FIG. 2 is an oblique view showing a cross-section of the connector assembly of FIG. 1. The first connector is connected to the second connector.

With reference to FIGS. 1 to 3, the structure of the second connector 200 is same as the structure of the first connector 100. Accordingly, the following explanation of the second connector 200 will be simplified.

The second connector 200 comprises a plurality of second male terminals 210, a plurality of second female terminal 220 and a second holding member 230. The second holding member 230 holds the second male terminals 210 and the second female terminals 220.

Each of the second male terminals 210 comprises a second male contact 212. The second male contact 212 extends and is oriented in a second horizontal direction. In this embodiment, the second horizontal direction is an unidirectional direction from a base of the second male contact 212 toward a tip of the second male contact 212, as shown in FIG. 3. Each of the second female terminals 220 comprises the second female contact 222. The second female contact 222 opens toward the second horizontal direction. In other words, a direction where the second female contact 222 opens is same as a direction where the second male contact 212 is oriented.

Figure 7:
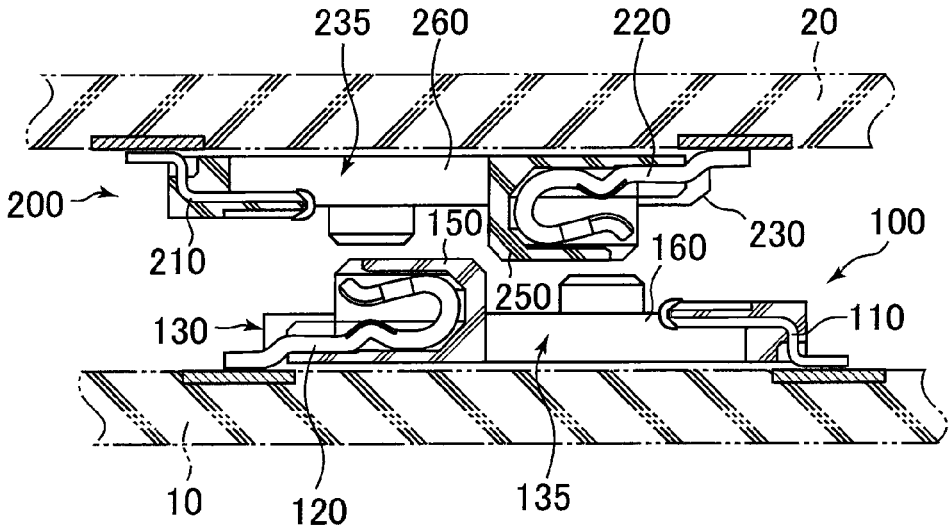
FIG. 7 is a cross-sectional view showing a connection process of the first connector and the second connector of FIG. 3.

The second holding member 230 comprises a second male holding portion 240, a second female holding portion 250 and a second connection portion 260. The second male holding portion 240 and the second female holding portion 250 extends along a fourth horizontal direction perpendicular to the second horizontal direction and the vertical direction (i.e., similarly to the third horizontal direction, the fourth horizontal direction is not unidirectional but bidirectional). The second male holding portion 240 holds the second male terminals 210 so that the second male terminals 210 are arranged in a single row in the fourth horizontal direction. The second female holding portion 250 holds the second female terminals 220 so that the second female terminals 220 are arranged in a single row in the fourth horizontal direction. The second connection portion 260 connects between the second male holding portion 240 and the second female holding portion 250 in the second horizontal direction. The second holding member 230 comprises a second accommodation portion 235. With reference to FIG. 7, the second accommodation portion 235 is an inner space surrounded by the second male holding portion 240, the second female holding portion 250 and the second connection portion 260.

Figure 8:
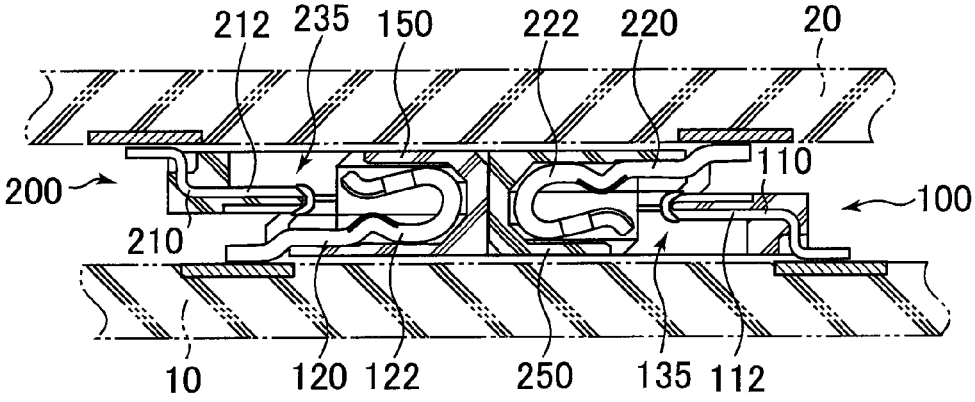
FIG. 8 is a cross-sectional view showing another connection process following the connection process of FIG. 7.

The first connector 100 and the second connector 200 are connected with each other by connection process shown in FIGS. 3, 7 and 8. The following explanation is made about the connection process of the second connector 200 to the first connector 100.

With reference to FIG. 7, the first connector 100 and the second connector 200 are arranged so that the first horizontal direction and the second horizontal direction are opposed to each other. The first female holding portion 150 faces the second accommodation portion 235 while the second female holding portion 250 faces the first accommodation portion 135.

With reference to FIGS. 7 and 8, the second connector 200 is moved down in the vertical direction. As shown in FIG. 8, the second connector 200 is positioned at a relative predetermined position. When the second connector 200 is positioned at the relative predetermined position, the first accommodation portion 135 accommodates the second female holding portion 250 while the second accommodation portion 235 accommodates the first female holding portion 150. The first male contact 112 is directed to but is apart from the second female contact 222 while the second male contact 212 is directed to but is apart from the first female contact 122.

As explained above, the heights of the first connection portion 160 and the second connection portion 260 are about half of the heights of the first female holding portion 150 and the second female holding portion 250, respectively. When the second connector 200 is completely moved down in the vertical direction (i.e., the second connector 200 is positioned at the relative predetermined position), the first connection portion 160 and the second connection portion 260 are brought into contact with each other. In other words, the first connection portion 160 and the second connection portion 260 serve as a positioning mechanism which positions the second connector 200 relative to the first connector 100 at the relative predetermined position in the vertical direction.

With reference to FIGS. 3 and 8, when the second connector 200 is moved from the relative predetermined position along the second horizontal direction, the first male contact 112 is connected to the second female contact 222 while the second male contact 212 is connected to the first female contact 122. In this state, the second connector 200 is positioned at a connection position, as shown in FIG. 3. In this embodiment, during the movement of the second connector 200 along the second horizontal direction, the second connection portion 260 slides on the first connection portion 160 so that a vertical relation between the first male contact 112 and the second female contact 222 is maintained while another vertical relation between the second male contact 212 and the first female contact 122 is maintained. In other words, the connection portion 160 and the connection portion 260 serve as a guide mechanism which guides the relative movement of the second connector 200 to the first connector 100 from the relative predetermined position to the connection position along the second horizontal direction.

With reference to FIGS. 2 and 7, the length of the first accommodation portion 135 in the third horizontal direction is slightly larger than the length of the second female holding portion 250 in the fourth horizontal direction while the length of the second accommodation portion 235 in the fourth horizontal direction is slightly larger than the length of the first female holding portion 150 in the third horizontal direction. With this structure, relative movement of the second connector 200 to the first connector 100 in the third (fourth) horizontal direction is prevented during the second connector 200 is moved from the relative predetermined position to the connection position. The terminals 210, 220 of the second connector 200 can be accordingly connected to the corresponding terminals 120, 110 of the first connector 100 by simply moving the second connector 200 along the second horizontal direction.

Moreover, in this embodiment, when the second connector 200 is positioned at the relative predetermined position, the projection portions 162 of the first connection portion 160 are accommodated in the groove portions of the second connection portion 260 while the projection portions of the second connection portion 260 are accommodated in the groove portions 164 of the first connection portion 160. With this structure, undesired relative movement of the second connector 200 along the third (fourth) horizontal direction is prevented during the second connector 200 moves from the relative predetermined position to the connection position.

As explained above, the connection between the connectors 100, 200 of the present embodiment is established by moving the second connector 200 in the vertical direction, followed by further moving in the horizontal direction (the second horizontal direction). With these processes, the connectors 100, 200 can be easily connected to each other even if the height of the connector assembly 1 is reduced. Thus, the structure of the connector assembly of the present embodiment is suitable for the low-profile design.

In the above-described embodiment, the first accommodation portion 135 accommodates the second female holding portion 250 while the second accommodation portion 235 accommodates the first female holding portion 150. However, the first accommodation portion 135 may accommodate the second male holding portion 240 while the second accommodation portion 235 may accommodate the first male holding portion 140. In this case, the first female holding portion 150 may be formed backwards of the first male holding portion 140 while the second female holding portion 250 may be formed backwards of the second male holding portion 240.

The connector assembly of the above-described embodiment may be modified as follows. Hereinafter, the explanation of modifications will be generally made about the first connector. However, the second connector may be modified in the same manner.

Second Embodiment

Figure 9:
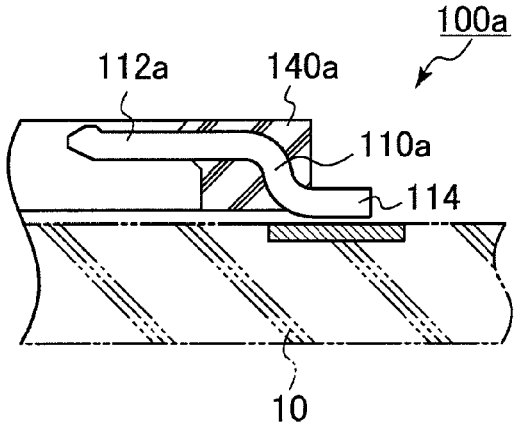
FIG. 9 is a partial, enlarged view showing a cross-section of a first male terminal held by a first connector according to a second embodiment of the present invention.

With reference to FIG. 9, a first connector 100*a* of the second embodiment of the present invention comprises a first male terminal 110*a* which has a crank-like shape when seen along the third horizontal direction. The first male holding portion 140*a* of the present embodiment has a rectangular-like cross-section in a plane perpendicular to the third horizontal direction and extends in the third horizontal direction. The first male holding portion 140*a* holds the first male terminals 110*a* so that the first male contacts 112*a* projects from the first male holding portion 140*a* and is oriented in the first horizontal direction.

The first male terminals 110*a* are held by the first male holding portion 140*a* by insert-molding process. However, the first male terminals 110*a* may be press-fitted into the first male holding portion 140*a*.

Third Embodiment

Figure 10:
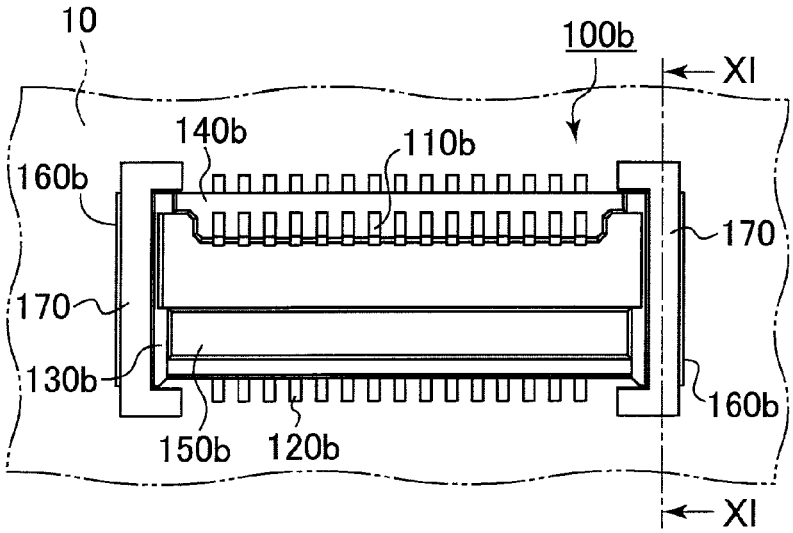
FIG. 10 is a plan view showing a first connector according to a third embodiment of the present invention.
Figure 11:
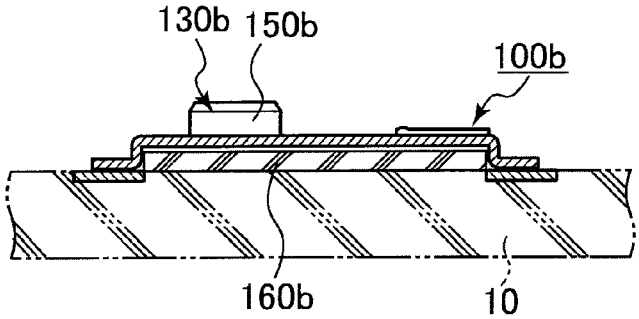
FIG. 11 is a cross-sectional view showing the first connector of FIG. 10, taken along lines XI-XI.

With reference to FIGS. 10 and 11, a first connector 100*b* of the third embodiment of the present invention comprises a first holding member 130*b* which has no projection portion 162 or groove portion 164 shown in FIG. 4. Similarly to the first holding member 130 of the first embodiment (see FIG. 4), the first holding member 130*b* comprises a first male holding portion 140*b*, a first female holding portion 150*b* and the first connection portion 160*b*. The first male holding portion 140*b* holds a plurality of first male terminals 110*b*. The first female holding portion 150*b* holds a plurality of first female terminals 120*b*. The first connection portion 160*b* connects the first male holding portion 140*b* and the first female holding portion 150*b* in the first horizontal direction. The first connection portion 160*b* comprises two connection bridges. The first connector 100*b* of the present embodiment further comprises two hold-downs 170 made of metal. As shown in FIG. 11, the hold-downs 170 are attached to the respective connection bridges of the first connection portion 160*b*. Each of the hold-downs 170 has end portions in the longitudinal direction. The end portions of the hold-down 170 are fixed to the first circuit board 10 by soldering so that the first connector 100*b* is firmly fixed to the first circuit board 10.

Fourth Embodiment

With reference to FIGS. 12 to 16, a first connector 100*c* of the fourth embodiment of the present invention comprises a first holding member 130*c* constituted by a first insulator member 310 and a first metal member 320.

Figure 14:
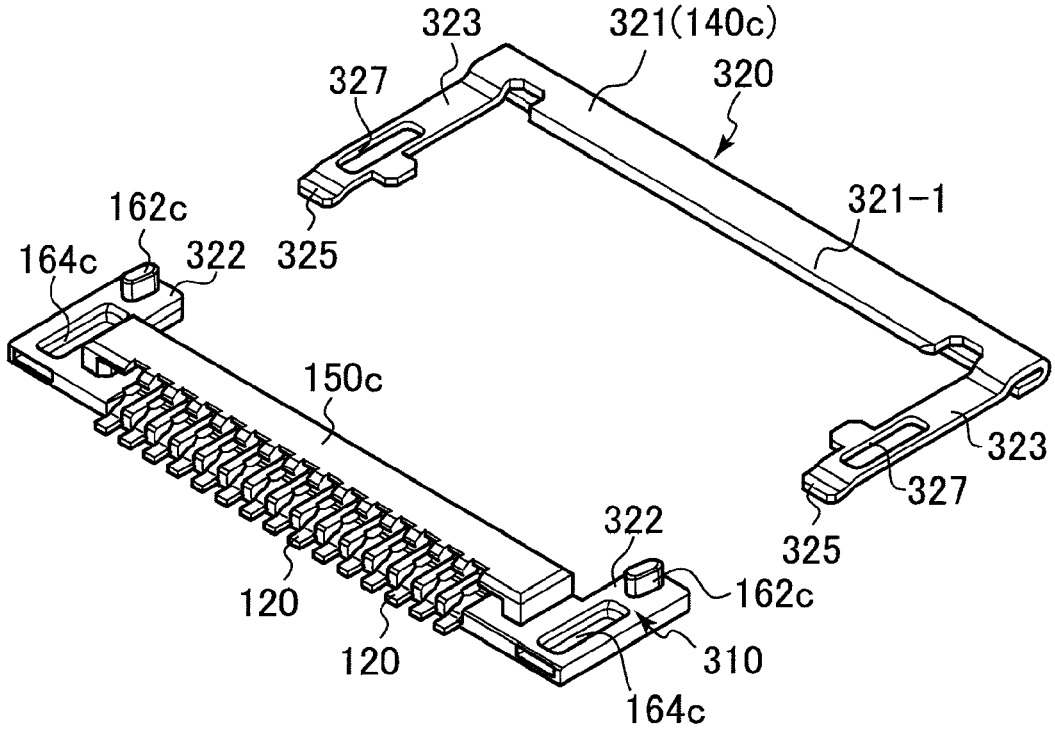
FIG. 14 is an exploded-oblique view showing a first holding member of the first connector of FIG. 12.

With reference to FIG. 14, the insulator member 310 comprises a first female holding portion 150*c* and two first arm portions 322. The structure of the first female holding portion 150*c* is same as the structure of the first female holding portion 150 of the first embodiment (see FIGS. 4 and 5). The first female holding portion 150*c* has two end portions in the third horizontal direction. The first arm portions 322 extend from the end portions of the first female holding portion 150*c* in a direction opposite to the first horizontal direction. As shown in FIG. 14, each of the first arm portions 322 of the present embodiment has a hollow-body and comprises a projection portion 162*c* and a groove portion 164*c*.

The first metal member 320 comprises a main portion 321 and two second arm portions 323. The main portion 321 extends in the third horizontal direction and has two end portions. The second arm portions 323 extend from the end portions of the main portion 321 in the first horizontal direction. Each of the second arm portions 323 comprises an opening 327 and has an end portion in the first horizontal direction. The end portion is provided with a fix portion 325. The fix portion 325 is configured to be fixed to the circuit board 10 so that the first connector 100*c* is fixed to the first circuit board 10.

Figure 13:
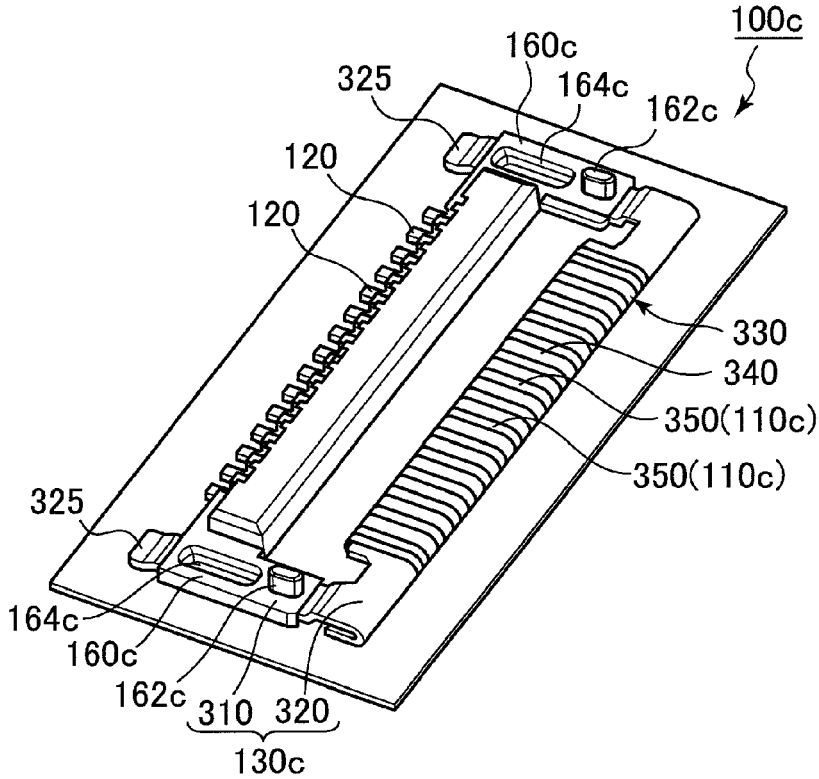
FIG. 13 is another oblique view showing the first connector of FIG. 12.

As understood from FIGS. 13 and 14, the first holding member 130*c* is assembled by inserting the second arm portions 323 into the hollows of the first arm portions 322. In this embodiment, the first arm portions 322 and the second arm portions 323 constitute the first connection portion 160*c*. As understood from FIGS. 13 and 14, the openings 327 of the second arm portions 323 correspond to the groove portions 164*c* of the first arm portions 322. Therefore, the second arm portions 323 do not cover the groove portion 164*c* when the first holding member 130*c* is assembled. The first holding member 130*c* of the present embodiment is formed by insert-molding process.

Figure 16:
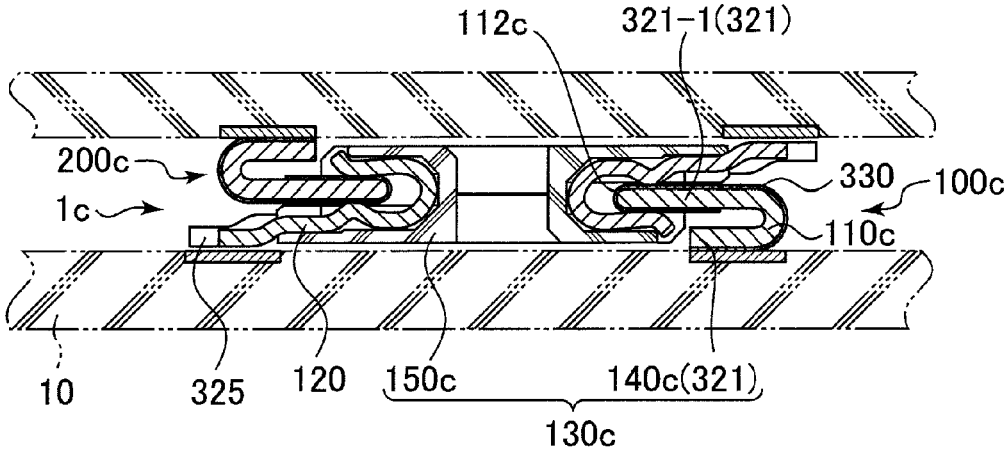
FIG. 16 is a cross-sectional view showing a connector assembly. The connector assembly comprises the first connector of FIG. 12 and a second connector. The first connector is connected to the second connector.

With reference to FIGS. 14 and 16, the main portion 321 of the first metal member 320 has a U-like cross-section in a plane perpendicular to the third horizontal direction. As shown in FIG. 16, the U-like cross-section of the first metal member 320 opens toward the first horizontal direction. The main portion 321 has a plate portion 321-1. As shown in FIG. 16, the plate portion 321-1 is formed on an upper part of the main portion 321. The plate portion 321-1 extends and is oriented in the first horizontal direction.

Figure 12:
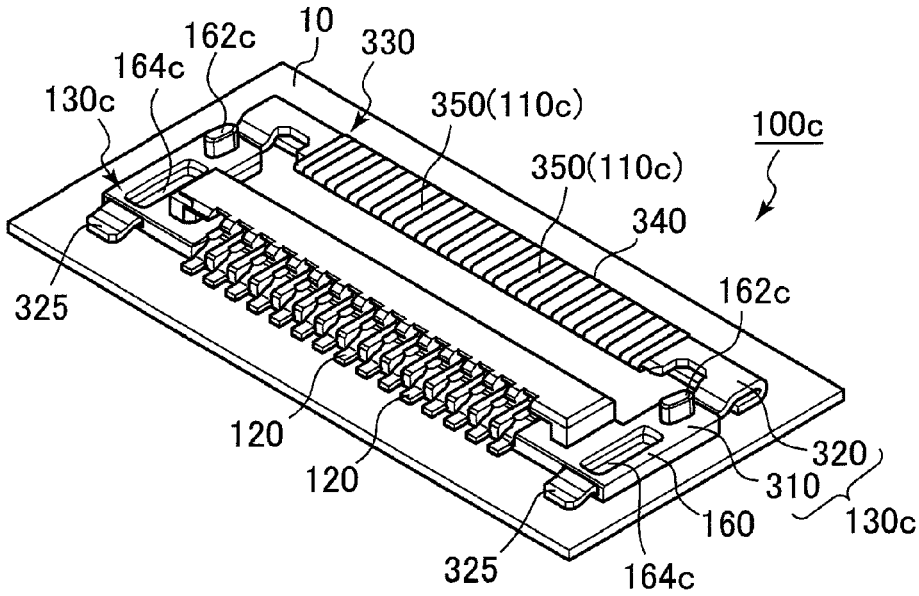
FIG. 12 is an oblique view showing a first connector used for a connector assembly according to a fourth embodiment of the present invention.
Figure 15:
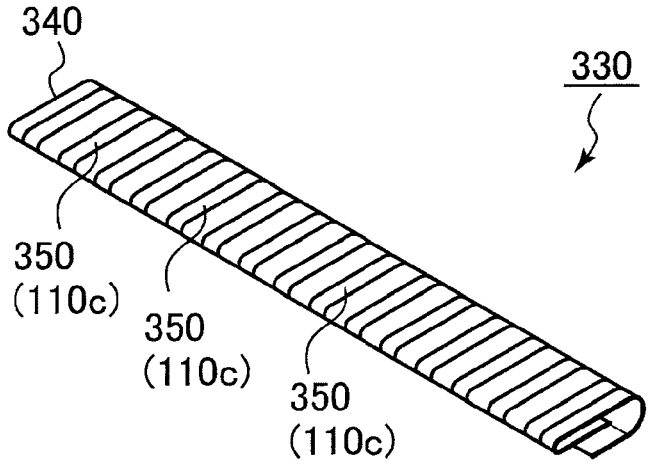
FIG. 15 is an oblique view showing a contact pattern film to be fixed to a first metal member.

With reference to FIGS. 12 and 13, a contact pattern film 330 is fixed to the main portion 321. The contact pattern film 330 comprises an insulation film 340 and a conductive pattern 350 formed on the insulation film 340, as shown in FIG. 15. With reference to FIG. 16, the conductive pattern 350 has a predetermined portion configured to be fixed to the plate portion 321-1. The predetermined portion of the conductive pattern 350 serves the first male contact 112*c* of the first male terminal 110*c*.

With reference to FIG. 16, the structure of the first connector 100*c* is same as the structure of the second connector 200*c*. However, one of the second connectors of the first to the third embodiment may be applied as the second connector 200*c*.

Fifth Embodiment

Figure 17:
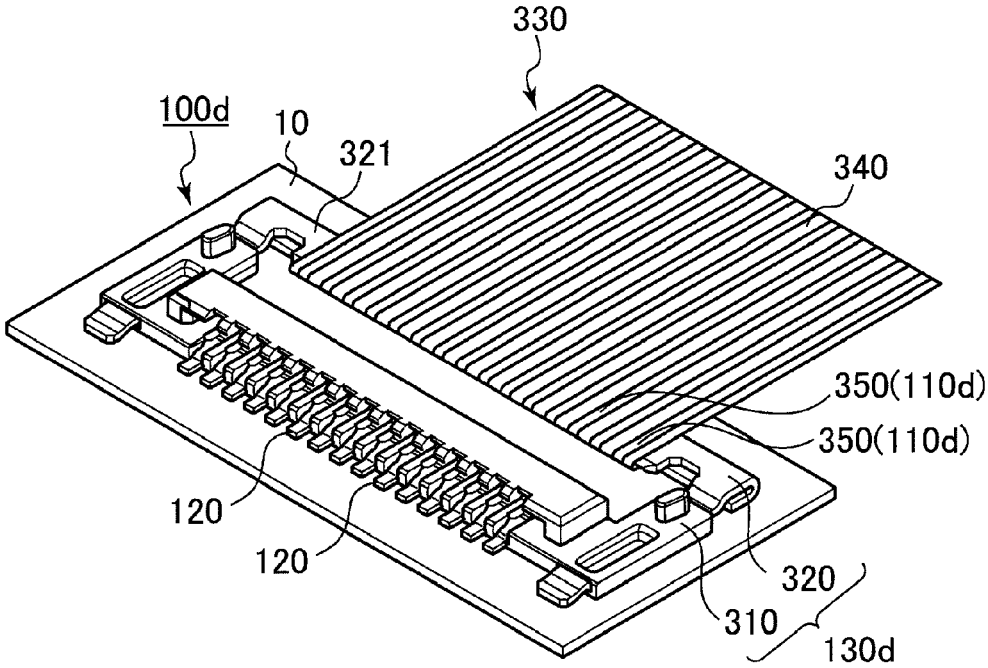
FIG. 17 is an oblique view showing a first connector according to a fifth embodiment.
Figure 18:
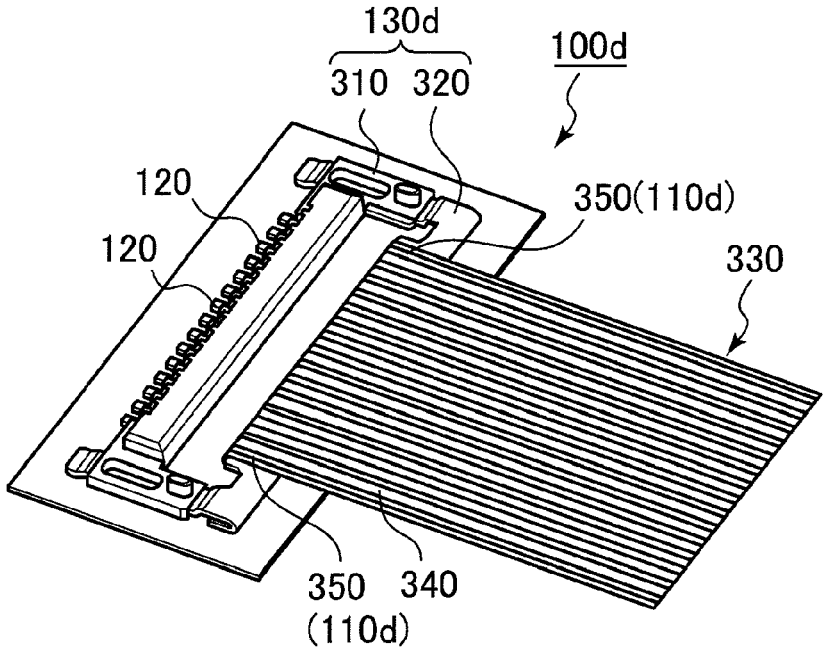
FIG. 18 is another oblique view showing the first connector of FIG. 17.
Figure 19:
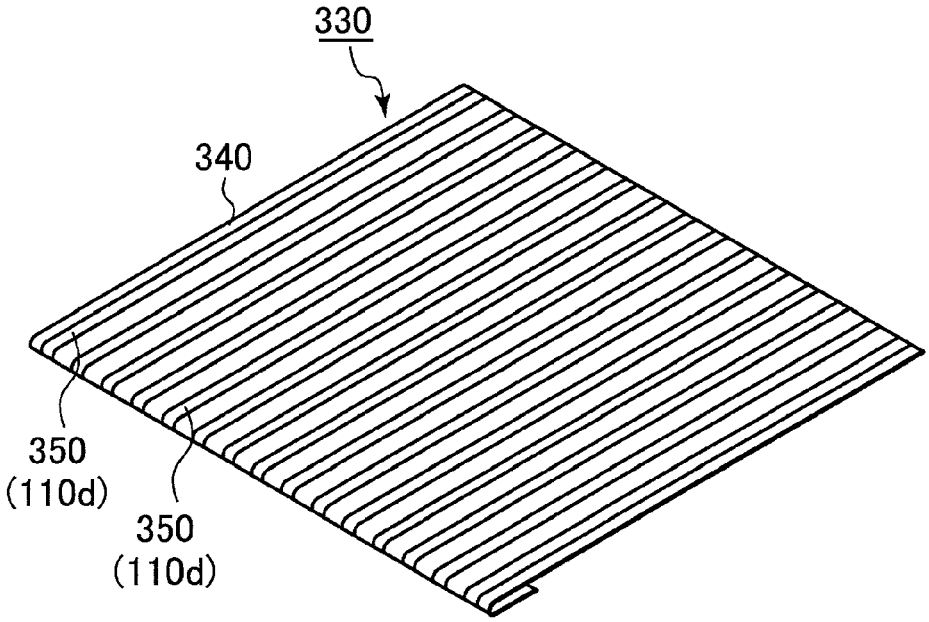
FIG. 19 is an oblique view showing a contact pattern film used for the first connector of FIG. 17.
Figure 20:
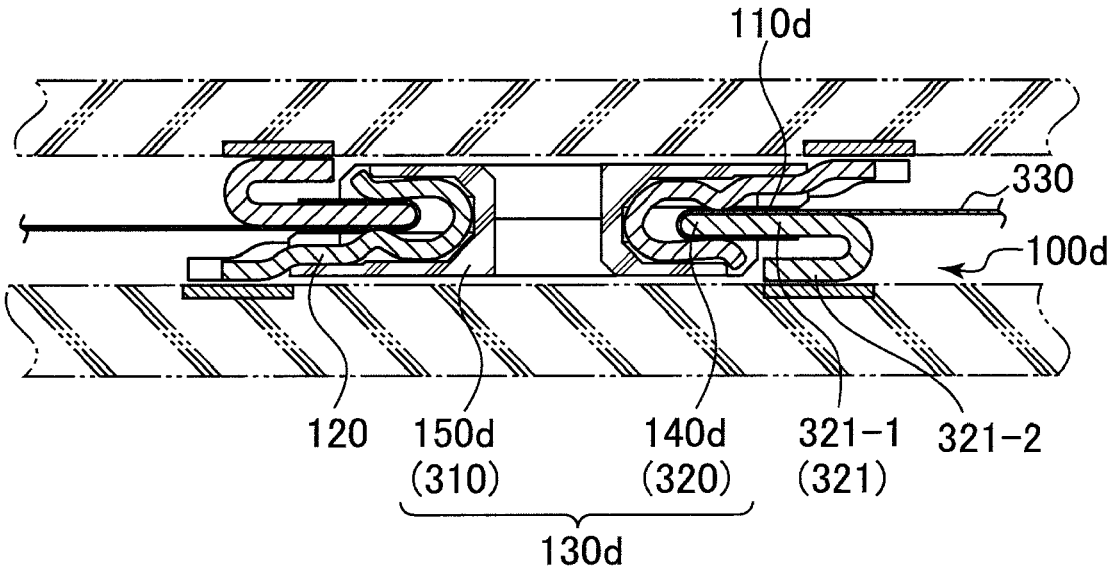
FIG. 20 is a cross-sectional view showing a connector assembly. The connector assembly comprises the first connector of FIG. 17 and a second connector. The first connector is connected to the second connector.

With reference to FIGS. 17 and 20, a connector of the fifth embodiment of the present invention relates to a modification of the contact pattern film 330. In other words, except for the contact pattern film 330, the structure of the first connector 100*d* is same as the structure of the first connector 100*c* of the fourth embodiment (see FIGS. 12 to 16). For example, the first connector 100*d* is configured to be installed on the first circuit board 10 and comprises the first holding member 130*d* constituted by the first insulator member 310 and the first metal member 320. The first insulator member 310 holds the first female terminals 120.

With reference to FIG. 20, the main portion 321 has the plate portion 321-1 and a plate portion 321-2. The contact pattern film 330 is fixed only to the front portion of the plate portion 321-1 of the main portion 321.

In detail, the contact pattern film 330 has a fix portion formed at its front end. The fix portion of the contact pattern film 330 is fixed to and is supported by the plate portion 321-1. In this embodiment, the plate portion 321-2 of the main portion 321 is glued to the first circuit board 10 so that the first connector 100*d* is fixed to the first circuit board 10 firmly.

Sixth Embodiment

Figure 21:
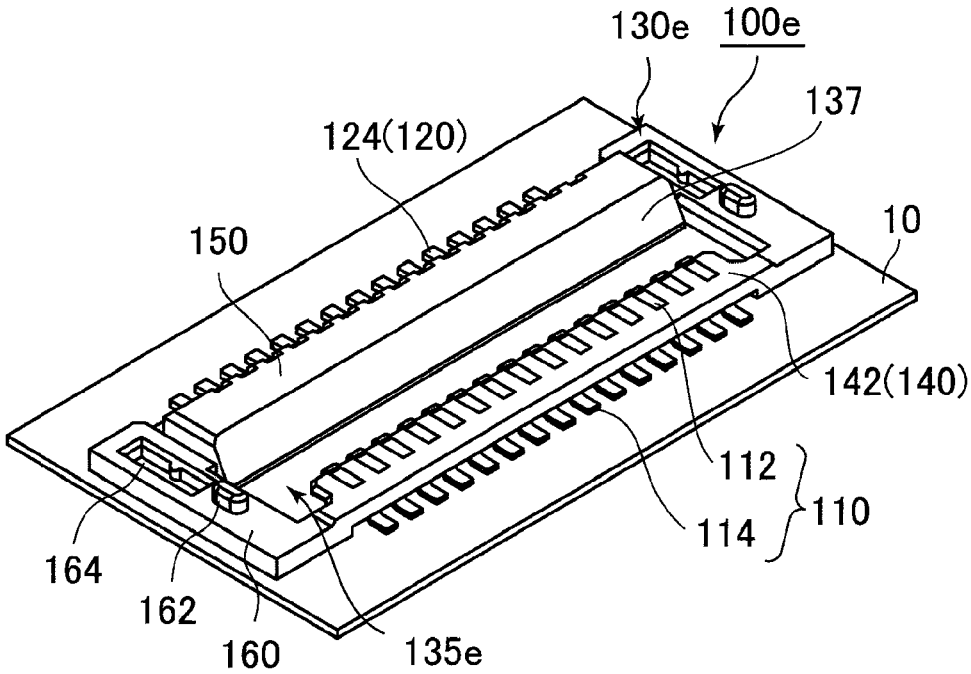
FIG. 21 is an oblique view showing a first connector of a sixth embodiment of the invention.
Figure 27:
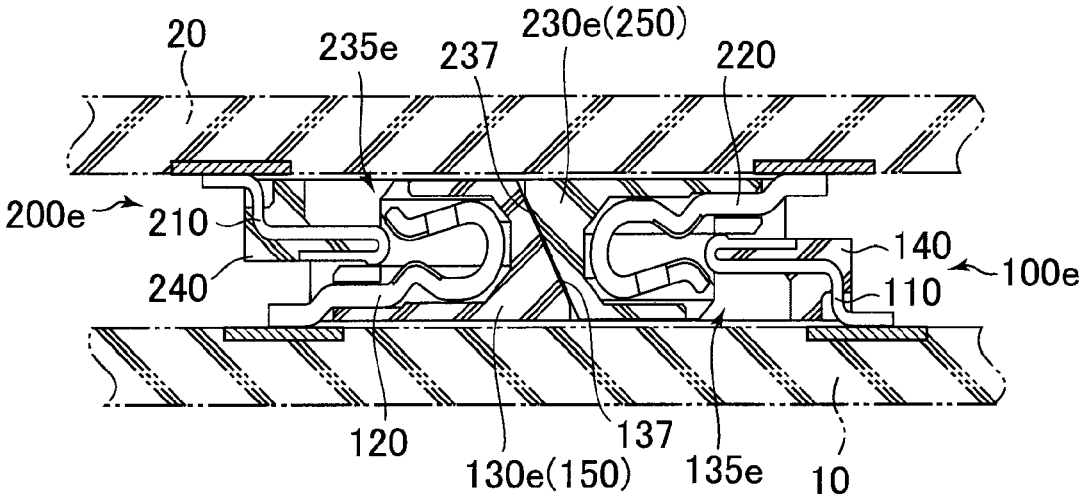
FIG. 27 is a cross-sectional view showing another connection process following the connection process of FIG. 26.

With reference to FIGS. 21 and 27, the connector assembly of the sixth embodiment of the present invention comprises the first connector 100*e* and the second connector 200*e*. The structure of the first connector 100*e* is same as the structure of the second connector 200*e*. The first connector 100*e* comprises a plurality of first male terminals 110, a plurality of first female terminals 120 and a first holding member 130*e*. The first holding member 130*e* is made of insulator. The first male terminals 110 are held by the first holding member 130*e* by insert-molding process. The first female terminals 120 are press-fitted to the first holding member 130*e*.

Similarly to the first holding member 130 of the first embodiment (see FIGS. 4 to 6), the first holding member 130*e* comprises a first connection portion 160. The first connection portion 160 connects the first male holding portion 140 and the first female holding portion 150 in the first horizontal direction.

Figure 22:
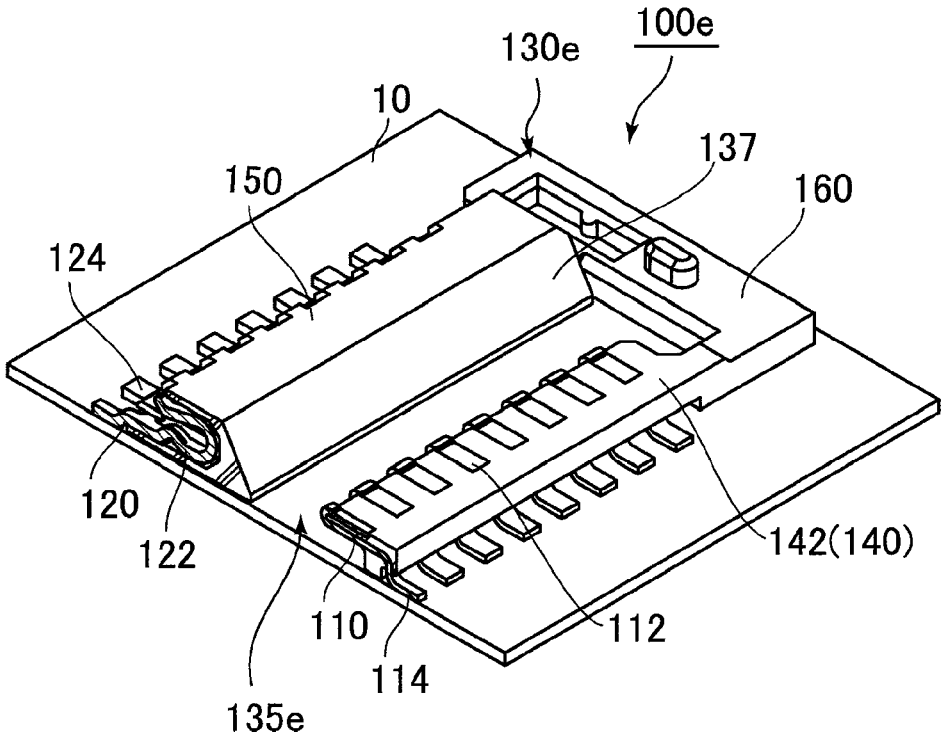
FIG. 22 is an oblique view showing a cross-section of the first connector of FIG. 21.
Figure 23:
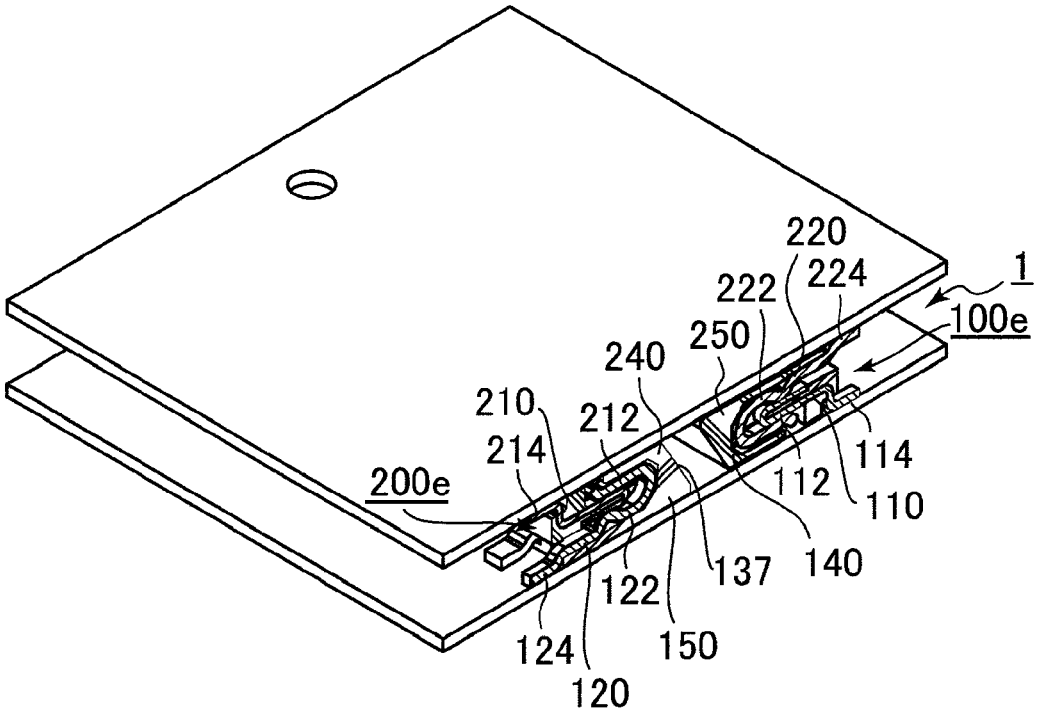
FIG. 23 is an oblique view showing a cross-section of a connector assembly. The connector assembly comprises the first connector of FIG. 21 and a second connector. The first connector is connected to the second connector.
Figure 25:
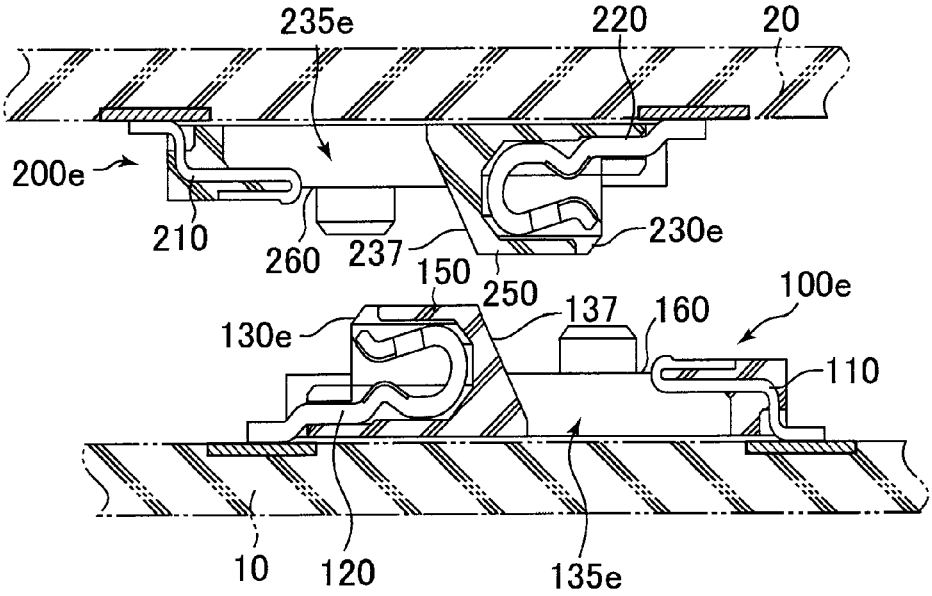
FIG. 25 is a cross-sectional view showing a connection process of the first connector and the second connector of FIG. 24.

With reference to FIGS. 21, 22 and 25, the first connector 100*e* of the present embodiment further comprises a first guide slope 137. The first guide slope 137 is obliquely to the vertical direction and the first horizontal direction. Specifically, as shown in FIGS. 22 and 25, the first guide slope 137 is sloped so that the lower end of the first guide slope 137 is closer to the first male terminals 110 than the upper end of the first guide slope 137. In other words, the lower end of the first guide slope 137 is positioned between the upper end of the first guide slope 137 and the first male terminals 110 in the first horizontal direction. The first guide slope 137 is configured to guide the relative movement of the second connector 200*e* to the first connector 100*e* in the vertical direction and the second horizontal direction when the second connector 200*e* is moved to the relative predetermined position.

With reference to FIG. 25, similarly to the first connector 100*e*, the second connector 200*e* further comprises a second guide slope 237 obliquely to the vertical direction and the second horizontal direction. The second guide slope 237 guides the relative movement of the first connector 100*e* to the second connector 200*e* in the vertical direction and the first horizontal direction when the first connector 100*e* is relatively moved toward the second connector 200*e*.

The first connector 100*e* is connected with the second connector 200*e* as follows. With reference to FIG. 25, the first connector 100*e* and the second connector 200*e* are arranged so that the first horizontal direction and the second horizontal direction are opposed to each other. The first female holding portion 150 faces the second accommodation portion 235*e* while the second female holding portion 250 faces the first accommodation portion 135*e*.

Figure 26:
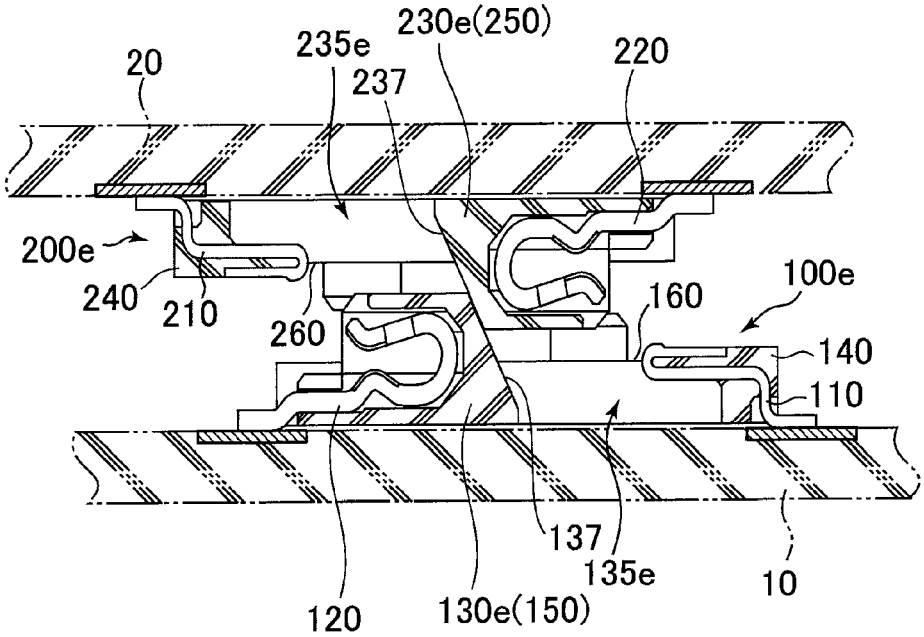
FIG. 26 is a cross-sectional view showing another connection process following the connection process of FIG. 25.

With reference to FIGS. 25 and 26, when the second connector 200*e* is moved down in the vertical direction, the second guide slope 237 is brought into contact with the first guide slope 137. In this embodiment, the structure of the first connector 100*e* is same as the structure of the second connector 200*e*. In other words, an angle of the first guide slope 137 with respect to the vertical direction is equal to another angle of the second guide slope 237 with respect to the vertical direction. The second guide slope 237 and the first guide slope 137 make a surface-to-surface contact.

When the second connector 200*e* is further moved down, the second guide slope 237 is slid on the first guide slope 137. The second connector 200*e* is guided to the relative predetermined position while moving in the vertical direction and in the second horizontal direction.

With reference to FIGS. 26 and 27, when the second connector 200*e* is completely moved down (i.e. when the second connector 200*e* is positioned at the relative predetermined position, as shown in FIG. 27), the first connection portion 160 is brought into contact with the second connection portion 260.

Figure 24:
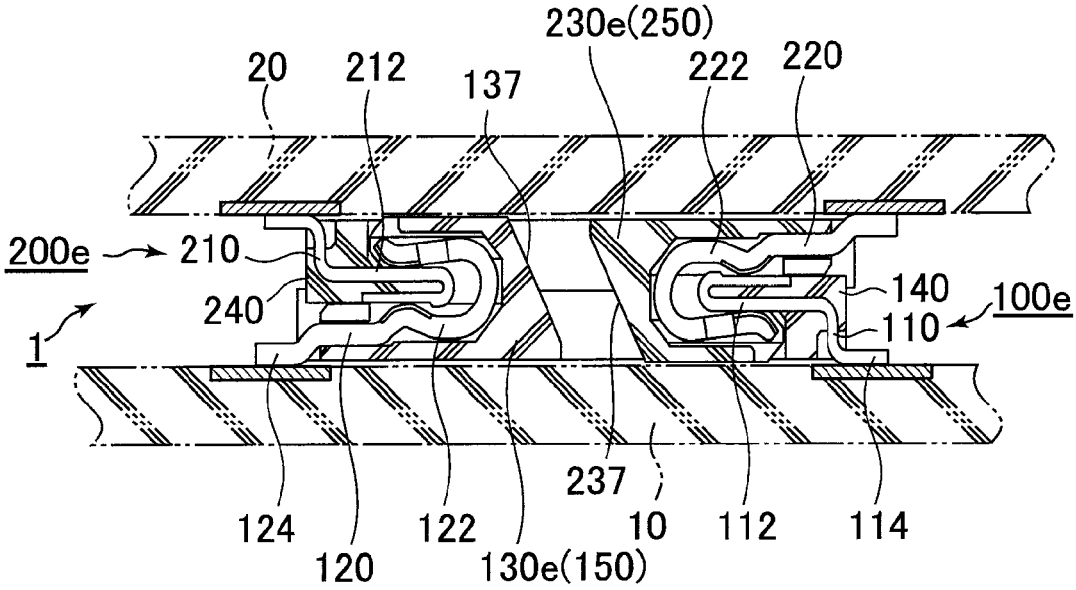
FIG. 24 is a cross-sectional view showing the connector assembly of FIG. 23.

With reference to FIGS. 24 and 27, when the second connector 200*e* is moved from the relative predetermined position (FIG. 27) to the connection position (FIG. 24) along the second horizontal direction so that the second male contacts 212 are connected to the corresponding first female contacts 122 while the first male contact 112 is connected to the second female contact 222.

Because of the first guide slope 137 and the second guide slope 237, a distance between the first male terminal 110 and the second female terminal 220 can be smaller than those of the first to fifth embodiments explained above.

The connector assembly of the present invention may be configured to be connected to a FPC/FFC. For example, the first connector may be connected to the FPC/FFC while the second connector may be connected to the FPC/FFC or the circuit board.

In the above-explained embodiments, the structure of the first connector is same as the structure of the second connector. However, the structure of the first connector may be different from the structure of the second connector. In addition, the structure of the first male terminal may be different from the structure of the second male terminal while the structure of the first female terminal may be different from the structure of the second female terminal.

The present application is based on a Japanese patent applications of JP 2010-079568 and JP 2010-157589 filed before the Japan Patent Office on Mar. 30, 2010 and Jul. 12, 2010, respectively, the contents of which are incorporated herein by reference.

While there has been described what is believed to be the preferred embodiment of the invention, those skilled in the art will recognize that other and further alternative embodiments may be made thereto without departing from the spirit of the invention, and it is intended to claim all such embodiments that fall within the true scope of the invention.

What is claimed is:

1. A connector assembly comprising:

a first connector comprising:

a first holding member, a plurality of first male terminals, and a plurality of first female terminals, wherein the first holding member holds the first male terminals and the first female terminals, wherein each of the first male terminals comprises a first male contact which extends and is oriented in a first horizontal direction, and wherein each of the first female terminals comprises a first female contact which opens toward the first horizontal direction;

a second connector comprising:

a second holding member, a plurality of second male terminals, and a plurality of second female terminals, wherein the second holding member holds the second male terminals and the second female terminals, wherein each of the second male terminals comprises a second male contact which extends and is oriented in a second horizontal direction, the first female contacts being receivable of the second male contacts, and wherein each of the second female terminals comprises a second female contact which opens toward the second horizontal direction, the second female contacts being receivable of the first male contacts;

a positioning mechanism configured to position the second connector relative to the first connector at a relative predetermined position in a vertical direction perpendicular to the first horizontal direction and the second horizontal direction when the first connector and the second connector are arranged so that the first horizontal direction and the second horizontal direction are opposed to each other, the relative predetermined position being a position where the first male contacts are directed to but are apart from the second female contacts in the first horizontal direction while the second male contacts are directed to but are apart from the first female contacts in the second horizontal direction; and a guiding mechanism configured to guide the second connector to the first connector from the relative predetermined position to a connection position along the second horizontal direction, the connection position being a position where the first male contacts are connected to the second female contacts while the second male contacts are connected to the first female contacts;

wherein the first holding member comprises:

a first male holding portion which is configured to hold the first male terminals to arrange the first male terminals in a third horizontal direction perpendicular to the first horizontal direction, a first female holding portion which is configured to hold the first female terminals to arrange the first female terminals in the third horizontal direction, and a first accommodation portion positioned between the first male holding portion and the first female holding portion in the first horizontal direction;

wherein the second holding member comprises:

a second male holding portion which is configured to hold the second male terminals to arrange the second male terminals in a fourth horizontal direction perpendicular to the second horizontal direction, a second female holding portion which is configured to hold the second female terminals to arrange the second female terminals in the fourth horizontal direction, and a second accommodation portion positioned between the second male holding portion and the second female holding portion in the second horizontal direction;

wherein when the second connector is positioned at the relative predetermined position, the first accommodation portion accommodates one of the second male holding portion and the second female holding portion while the second accommodation portion accommodates one of the first male holding portion and the first female holding portion;

wherein the first accommodation portion and the second accommodation portion are configured to prevent relative movement of the second connector in the third horizontal direction and the fourth horizontal direction; and wherein the first connector and the second connector are configured to be installed on and fixed to first and second circuit boards, respectively.

2. The connector assembly according to claim 1, wherein the first accommodation portion accommodates the second female holding portion while the second accommodation portion accommodates the first female holding portion.

3. The connector assembly according to claim 1, wherein:

the first male terminals are arranged in a first single row;

the first female terminals are arranged in a second single row;

the second male terminals are arranged in a third single row; and the second female terminals are arranged in a fourth single row.

4. The connector assembly according to claim 1, wherein:

the first holding member further comprises a first connection portion connecting between the first male holding portion and the first female holding portion in the first horizontal direction, and the second holding member further comprises a second connection portion connecting between the second male holding portion and the second female holding portion in the second horizontal direction.

5. The connector assembly according to claim 4, wherein:

the first connection portion comprises a projection portion projecting in a predetermined direction perpendicular to the first horizontal direction, the second connection portion comprises a groove portion extending along the second horizontal direction, and when the second connector is positioned at the relative predetermined position, the projection portion is accommodated in the groove portion so that the relative movement of the second connector along the third horizontal direction and the fourth horizontal direction is prevented.

6. The connector assembly according to claim 1, wherein each of the first male terminals further comprises an insulation film and a conductive pattern formed on the insulation film.

7. The connector assembly according to claim 6, wherein:

the first male holding portion is formed of metal, and at least a part of the insulation film is fixed to the first male holding portion.

8. The connector assembly according to claim 1, wherein:

each of the first male terminals comprises a first male SMT terminal, the first male holding portion is configured to hold the first male terminals so that each of the first male SMT terminals is oriented to extend in a direction opposite to the first horizontal direction, each of the first female terminals comprises a first female SMT terminal, and the first female holding portion is configured to hold the first female terminals so that each of the first female SMT terminals is oriented to extend in the first horizontal direction.

9. The connector assembly according to claim 1, wherein:

a structure of the first male terminals is the same as a structure of the second male terminals; and a structure of the first female terminals is the same as a structure of the second female terminals.

10. The connector assembly according to claim 1, wherein a structure of the first connector is the same as a structure of the second connector.

11. The connector assembly according to claim 1, wherein:

the first connector further comprises a first guide slope oblique to the vertical direction and the first horizontal direction;

the second connector further comprises a second guide slope oblique to the vertical direction and the second horizontal direction; and the first guide slope and the second guide slope are configured to relatively slide on each other so that, when the second connector is moved to the relative predetermined position, the second connector is moved both in the vertical direction and the second horizontal direction.

* * * * *